US005395279A

United States Patent [19]

McCann

[11] Patent Number: 5,395,279

[45] Date of Patent: Mar. 7, 1995

[54] INFANT FLEXIBLE TOY

[76] Inventor: Regis A. McCann, 361A, Rte. 28A, R.D. #1, West Hurley, N.Y. 12491

[21] Appl. No.: 217,710

[22] Filed: Mar. 25, 1994

[51] Int. Cl.[6] ..... A63H 33/00

[52] U.S. Cl. ..... 446/487; 446/489; 446/490

[58] Field of Search ..... 446/487, 489, 419, 490, 446/418, 119, 227; 273/155, 156, 159; D21/65

[56] References Cited

U.S. PATENT DOCUMENTS 1,287,397 12/1918 Morse ..... 446/487

4,778,184 10/1988 Fleischer ..... 273/155

FOREIGN PATENT DOCUMENTS 1179696 5/1959 France ..... 446/119

*Primary Examiner*—Mickey Yu

*Attorney, Agent, or Firm*—Charles J. Brown

[57] ABSTRACT

A multi-cornered flexible toy particularly suitable for infants wherein at least four tubes are held together end-to-end to define at least four corners by means of a closed loop cord extending through all of the tubes with an equal plurality of runs of the cord in each tube, including protective caps and ornamental slidable elements on the tubes.

6 Claims, 2 Drawing Sheets

INFANT FLEXIBLE TOY

BACKGROUND OF THE INVENTION

This invention constitutes a specific improvement to a certain toy described in U.S. Pat. No. 4,778,184. That prior art toy comprises four first tubes disposed substantially end-to-end defining four first corners, four second tubes disposed substantially end-to-end defining four second corners and four third tubes disposed between respective paired first and second corners of the first and second tubes. Cord means extend through all of the tubes to hold the adjacent ends of the tubes flexibly together at the eight corners.

The prior art toy of the aforementioned patent was not intended, and indeed is unsuitable, for use by infants for two reasons. First, the squared-off tube ends are left unprotected and could present sufficiently sharp edges to cause injury if handled by an infant. Second, the prior art toy lacks manipulatable ornamental elements attractive to an infant in a manner similar to a baby's rattle.

Another characteristic of this prior art toy open to improvement concerns the cord means threaded through the twelve tubes to hold them together. While the patent mentions that there may be any number of ways of stringing the cord through the tubes, those ways specifically disclosed result in an unequal number of runs of the cord in the various tubes. Thus, one of the cord threading arrangements disclosed in the patent results in a single run of the cord in some tubes, a double run of the cord in other tubes and a triple run in still another of the tubes. The other method of threading the cord disclosed in the patent results in single and double runs of the cord in various of the tubes. In any case connections between two given tubes where more runs of the cord are in one of the tubes than in the other results in unequal securement. A tube connected to its neighbor by only one run of the cord is arguably less securely connected than is a tube connected to its neighbor by two or three runs of the cord.

SUMMARY OF THE INVENTION

The subject of this invention is an improvement in a multi-cornered flexible toy wherein at least four tubes are disposed substantially end-to-end defining at least four corners and cord means extend through all of the tubes to hold adjacent ends of the tubes flexibly together at the corners. The improvement comprises protective caps on the ends of the tubes allowing passage through the tubes of the cord means, and ornamental elements loosely disposed about at least some of the respective tubes and slidable between the associated caps on the respective tubes.

In a preferred form of the invention the cord means is a single closed loop cord which extends through all of the tubes with an equal plurality of runs of the cord in each tube to hold adjacent ends of the tubes flexibly together at the corners. Two runs of this single closed loop cord may extend through each of the tubes. There may be four first tubes disposed substantially end-to-end defining four first corners, four second tubes disposed substantially end-to-end defining four second and four third tubes disposed between respective paired first and second corners of the first and second tubes, and in that configuration two runs of the cord may be threaded in the same direction through the first and second tubes and in opposite directions through the third tubes.

The ornamental elements may comprise substantially ball-shaped members having an axial hole through which the associated tubes loosely extend.

The invention also contemplates the aforementioned multi-cornered flexible toy wherein the improvement comprises simply the single closed loop cord extending through all of the tubes with an equal plurality of runs of the cord in each tube to hold adjacent ends of the tubes flexibly together at the corners thereof.

DESCRIPTION OF PREFERRED EMBODIMENT

Figure 1:
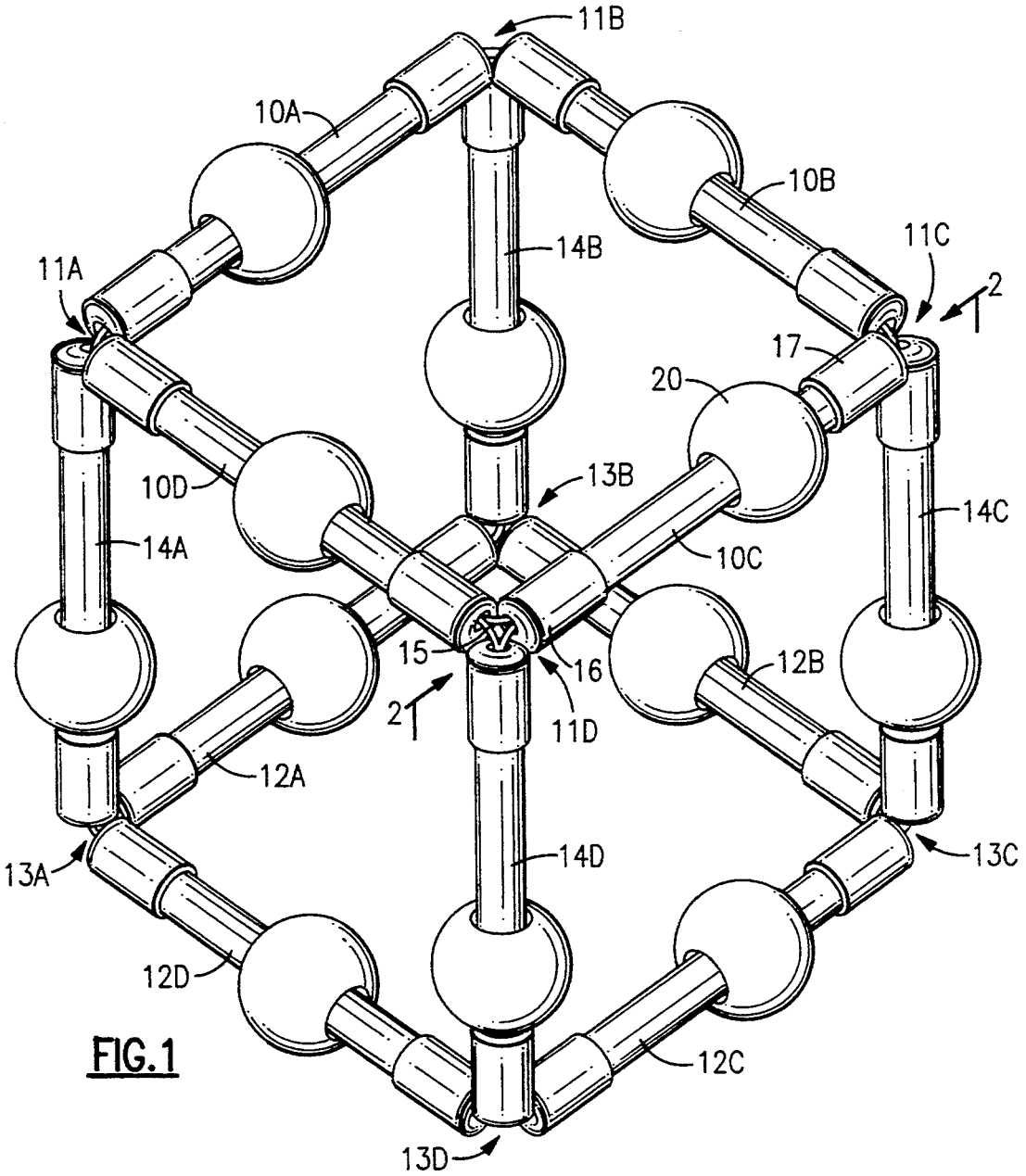
FIG. 1 is a perspective view of the assembled infant flexible toy of the invention wherein an eight-cornered configuration of the tube is shown in substantially cube form.

Referring first to FIG. 1 the infant toy of this embodiment includes four first tubes 10A, B, C and D disposed substantially end-to-end to define four first corners 11A, B, C and D. The toy also includes four second tubes 12A, B, C and D disposed substantially end-to-end to define four second corners 13A, B, C and D. Four third tubes 14A, B,C and D are disposed between respective first and second corners of the first and second tubes. Thus the third tube 14A is between the corners 11A and 13A, the third tube 14B is between the corners 11B and 13B, the third tube 14C is between the corners 11C and 13C and the third tube 14D is between the corners 11D and 13D. Cord means 15 hold all the twelve tubes flexibly together at the eight corners of the toy as described below.

It will be apparent that as few as four tubes defining four corners may be utilized in the multi-cornered flexible toy of the invention, and of course there may be more than twelve tubes defining more than eight corners.

Figure 2:
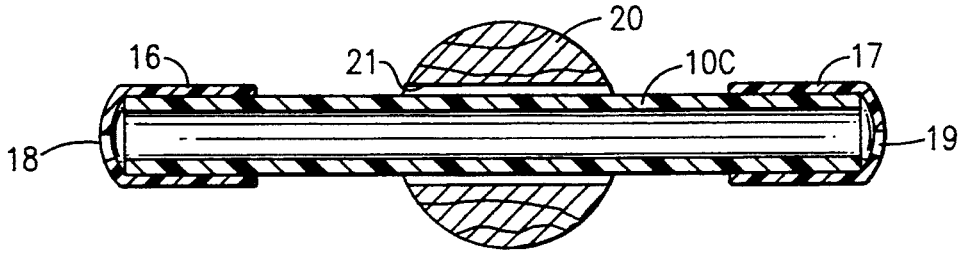
FIG. 2 is an enlarged section taken along the line 2—2 of FIG. 1 showing one representative tube with its associated protective caps and ornamental slide element.

Each of the first, second and third tubes 10A to D, 12A to D and 14A to D respectively is equipped with protective caps and an ornamental element as shown in FIG. 1 and more particularly in the enlarged FIG. 2 illustrating those components on the first tube 10C. Each of the tubes may be about five-sixteenths inch in outside diameter with an inside diameter of approximately three-sixteenths inch and with squared off ends, and its material must be non-toxic preferably of plastic. At one end of the tube is a cap 16 of non-toxic plastic force-fitted into place and at the other end is a similar force-fitted cap 17. The caps 16 and 17 are formed with small holes 18 and 19 which are somewhat off center to allow passage of the cord means 15 directed appropriately toward adjacent tubes at each of the eight corners of the toy.

An ornamental ball-shaped member 20 is formed with an axial hole 21 of measurably greater diameter than the outside diameter of the tube 10C. The ornamental member 20 may be of wood which is colored with non-toxic paint. Each of the ball members 20 is adapted to slide back and forth on its associated tube such as 10C in the manner of a baby rattle and is to be limited in its sliding path by the associated caps 16 and 17 which should therefore have an outside diameter slightly greater than the diameter of the hole 21 in the associated ball-shaped member 20.

Figure 3:
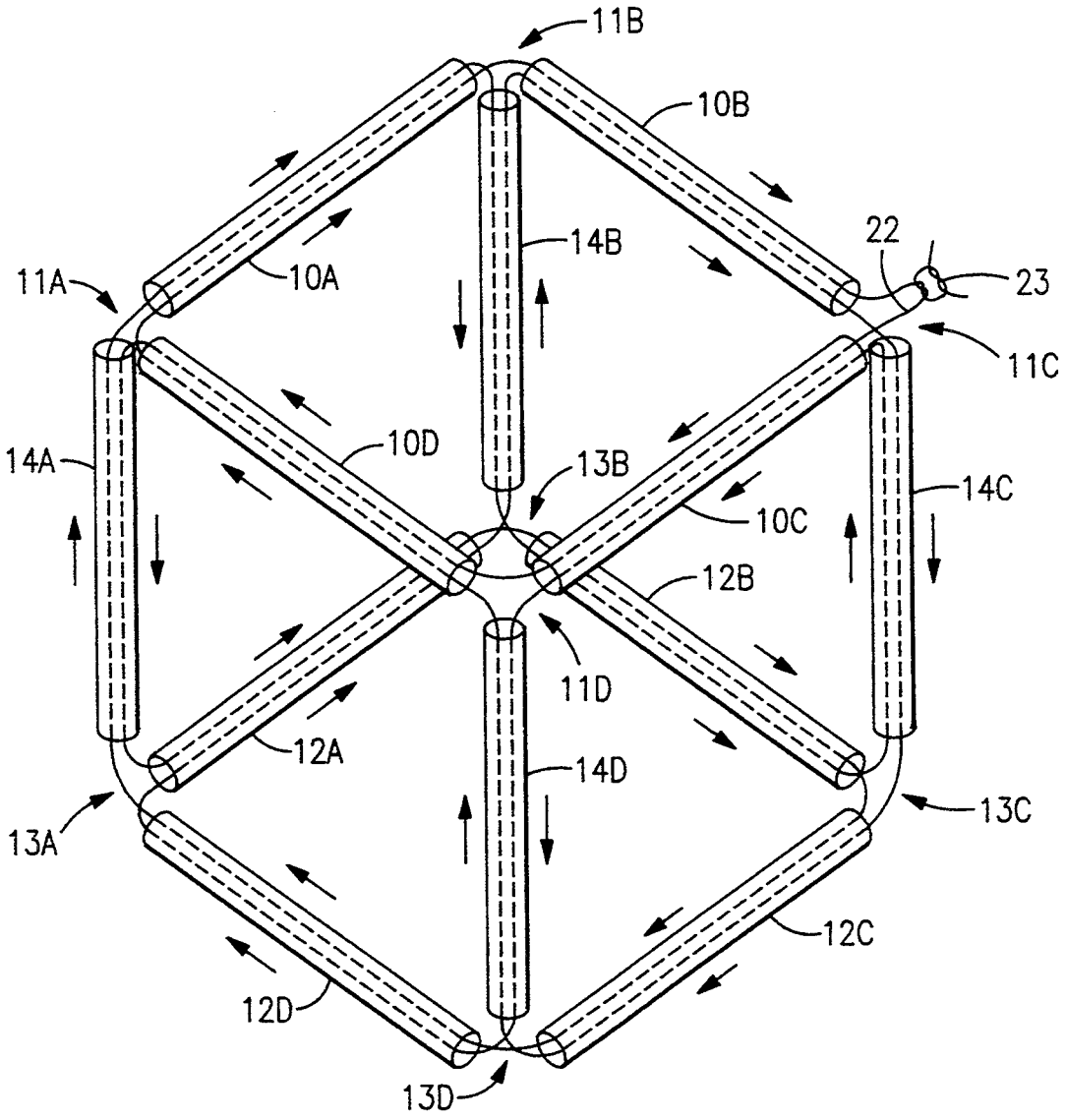
FIG. 3 is a perspective schematic view somewhat similar to FIG. 1 showing the single closed loop cord extending through all of the tubes.

In accordance with the invention the tubes are held together end-to-end in a flexible fashion by the cord means 15. In this preferred embodiment of the invention the cord means 15 is a single closed loop cord extending through all of the tubes with an equal plurality of runs of the cord, namely two, in each tube to hold adjacent ends of the tubes flexibly together at the eight corners of the toy. FIG. 3 illustrates the manner in which a cord 22 is threaded through the tubes to meet these requirements. From a knot 23 where the ends of the cord are later joined the cord 22 is threaded as shown by the direction of the arrows in FIG. 3. It is initially threaded through the first tube 10C, then through the first tube 10D, then through the third tube 14A, then through the second tube 12A, then through the second tube 12B, then through the second tube 12C, then through the second tube 12D, then through the third tube 14A, then through the first tube 10A, then through the third tube 14B, then through the second tube 12B, then through the third tube 14C, then through the first tube 10C, then through the third tube 14D, then through the second tube 12D, then through the second tube 12A, then through the third tube 14B, then through the first tube 10B, then through the third tube 14C, then through the second tube 12C, then through the third tube 14D, then through the first tube 10D, then through the first tube 10A, then through the first tube 10B and back to the knot 23 where it is tied after threading.

The result of this method of threading the cord 22 is that two runs of the cord are threaded in the same direction through the first tubes 10A to D and the second tubes 12A to D and in opposite directions through the third tubes 14A to D, all as shown by the arrows in FIG. 3. An equal number of runs of the cord are therefore in each of the tubes, which equalizes the integrity of the connections at the corners of the configuration. It is possible to achieve equal runs of the cord in each tube when the total number of tubes is other than twelve. In an embodiments of twenty-four or thirty tubes, for example, two runs of a single cord may be in each tube.

This flexible toy may be easily manipulated by an infant into various angular configurations other than the cube form shown in FIGS. 1 and 3. As this is done the slidable ball-shaped members 20 provide visually and aurally attractions for the infant user. The safety of the device is enhanced by the caps 16 and 17 which cover possibly sharp edges on the squared-off ends of each tube and prevent the slidable ball-shaped member 20 from sliding off its associated tube, while all twelve tubes are held together securely and equally by the double runs of the cord 22 threaded in the described special manner through the tubes.

The scope of the invention is to be determined by the following claims rather than the foregoing description of the preferred embodiment.

I claim:

1. In a multi-cornered flexible toy wherein tubes numbering at least six are disposed substantially end-to-end to define three dimensional corners numbering at least four and cord means extend through all of the tubes to hold adjacent ends of the tubes flexibly together at said corners, the improvement comprising a) protective caps on the ends of the tubes allowing passage through the tubes of the cord means, and b) ornamental elements loosely disposed about at least some of the respective tubes and slidable between the associated caps on the respective tubes.

2. A flexible toy according to claim 1 wherein the ornamental elements comprise substantially ball-shaped members having an axial hole through which the associated tubes loosely extend.

3. A flexible toy according to claim 1 wherein twelve tubes define eight corners.

4. A flexible toy according to claim 1 wherein the improvement further comprises cord means wherein a single closed loop cord extends through all of the tubes with an equal plurality of runs of the cord in each tube to hold adjacent ends of the tubes flexibly together at said corners.

5. A flexible toy according to claim 4 wherein two runs of the single closed loop cord extend through each of the tubes.

6. A flexible toy according to claim 4 wherein four first tubes are disposed substantially end-to-end defining four first corners, four second tubes are disposed substantially end-to-end defining four second corners, four third tubes are disposed between respective paired first and second corners of the first and second tubes, and two runs of cords are threaded in the same direction through the first and second tubes and in opposite directions through the third tubes.

* * * * *